United States Patent [19]

Gundlach et al.

[11] 4,061,281

[45] Dec. 6, 1977

[54] STRIKING PLATE FOR DISINTEGRATING MILL

[75] Inventors: Theodore F. Gundlach, Belleville, Ill.; Arthur L. Hawthorne, St. Clairsville, Ohio

[73] Assignee: J.M.J. Industries, Inc., Belleville, Ill.

[21] Appl. No.: 705,795

[22] Filed: July 16, 1976

[51] Int. Cl.[2] ..... B02C 13/10

[52] U.S. Cl. ..... 241/188 R; 241/191

[58] Field of Search ..... 241/188 R, 188 A, 191, 241/195, 294

[56] References Cited

U.S. PATENT DOCUMENTS

| | | | |
|---|---|---|---|
| 1,272,473 | 7/1918 | Lombard | 241/188 A UX |
| 3,047,243 | 7/1962 | Meger et al. | 241/188 R |
| 3,549,093 | 12/1970 | Pallmann | 241/188 R X |
| 3,894,695 | 7/1975 | Bendedikter | 241/188 R X |

FOREIGN PATENT DOCUMENTS

| | | | |
|---|---|---|---|
| 2,159,189 | 6/1973 | Germany | 241/191 |

*Primary Examiner*—Gerald A. Dost
*Assistant Examiner*—Howard N. Goldberg
*Attorney, Agent, or Firm*—Cohn, Powell & Hind

[57] ABSTRACT

The replaceable striking plate, which has a leading impact face, extends between opposite rotor rings of a disintegrating mill, and provides the basis of an impact system. The leading impact face extends rearwardly from its inner edge toward its outer edge at an angle with respect to a radius substantially within the range of fifteen (15) degrees to thirty (30) degrees for the major portion of its radial height, and extends relatively forwardly to its outer edge for a minor portion of its radial height. The major impact face portion has sufficient radial height so that a slug of particles striking the face will all impact on that face without some particles overshooting the top and thereby missing impact. A clean face surface is provided for the impact of each succeeding "slug or ribbon sheet" of particles as they strike the face. A portion of the new slug does not impact onto a bed of old particles still remaining on the impact face from a previous slug. The radial height of the plate rearwardly from the impact face between the inner and outer edges is sufficient to maintain substantially the same angle and height of the major impact face portion during use and wear. The minor impact fact portion has sufficient radial height to accommodate a wash area at the juncture of the major and minor face portion as wear occurs. Integral flanges provided at each end of the plate and extending forwardly of the leading impact face, are provided with outwardly converging, flow-directing side surfaces adjacent the leading impact face and extending from the inner to the outer edge. The attachment of the striking plate between the rotor rings compresses the striking plate endwise for increased material strength.

8 Claims, 5 Drawing Figures

FIG. 4.
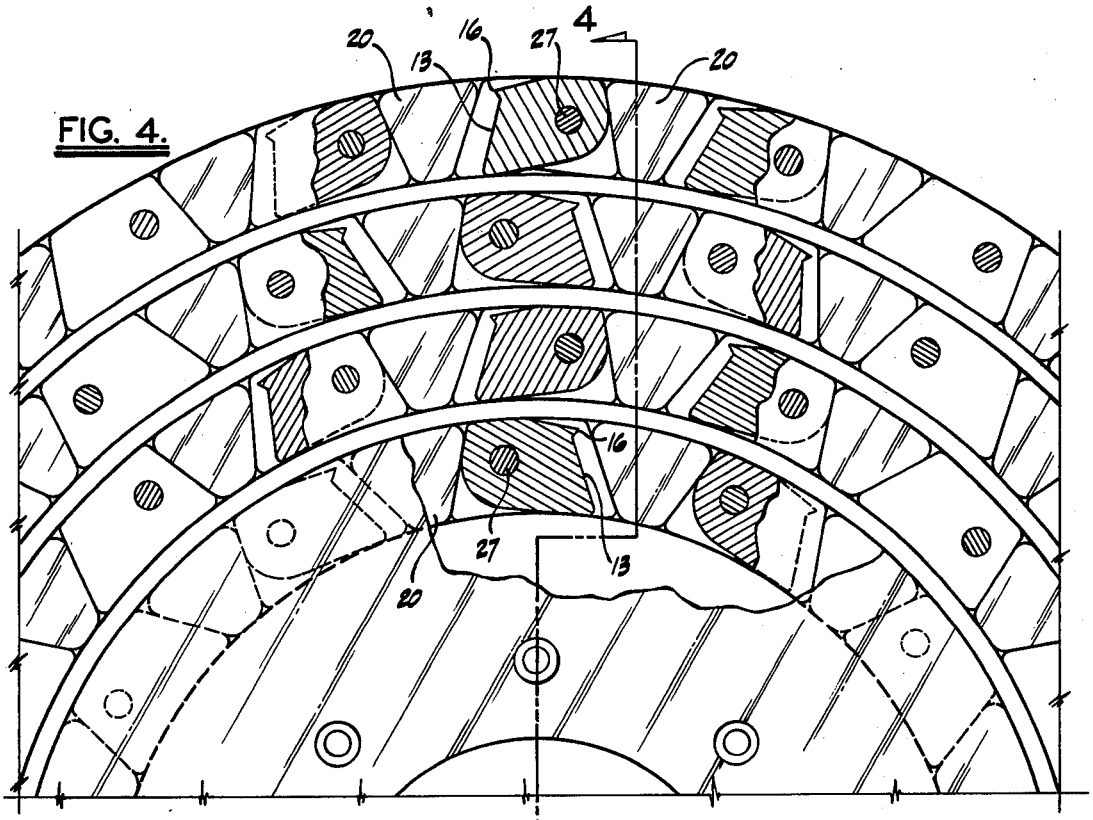
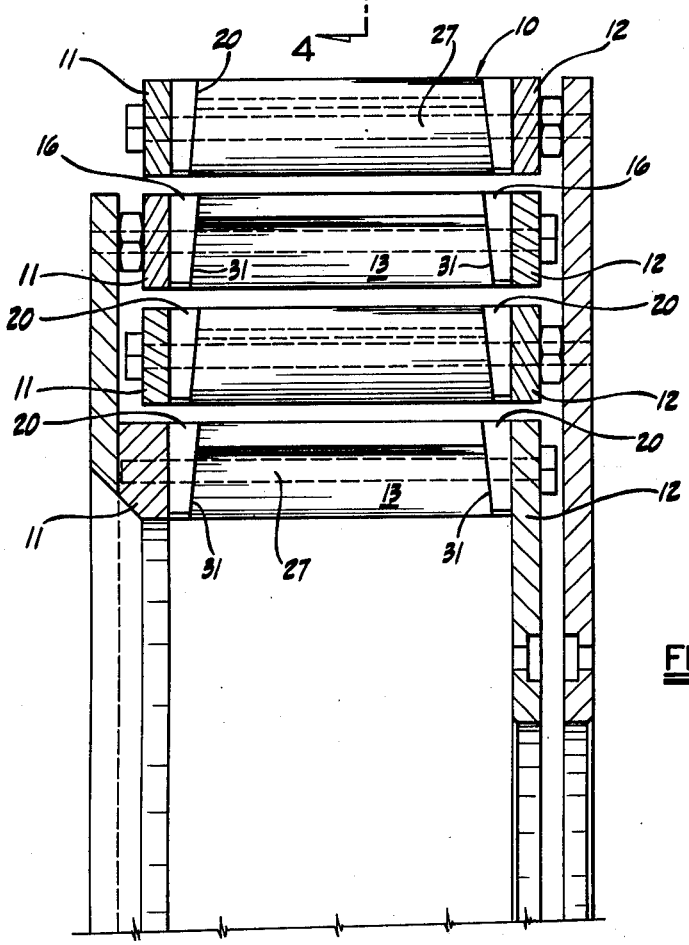
FIG. 5.

STRIKING PLATE FOR DISINTEGRATING MILL

BACKGROUND OF THE INVENTION

This invention relates generally to improvements in a striking plate, and to an impact means incorporating the striking plate between a pair of spaced rings of a rotor in a disintegrating mill.

One type of disintegrating mill in which the present invention can be utilized is fully disclosed in U.S. Pat. No. 3,047,243 issued July 31, 1962, the disclosure being incorporated and referred to herein.

Disintegrating mills of the type designated as internally-fed impact cage mills are employed to reduce solid granular material, such as stone, ore or other similar material to a finer particle size. The material is forced to travel outwardly by centrifugal force because of rotation of the cages of the mill, and as the particles of material move radially outwardly, they are struck by suitable impact means in the cages which shatter or disintegrate the material to reduce it to smaller size. In the heretofore conventional mills, the striking plate is usually worn severely on the radially inner edge of the leading impact face, resulting in a partially rounded impact face. The rounder this face becomes, the more non-uniform the impact forces become for the different particles. Controlling the direction and hence the relative force of impact of the majority of the particles being processed was the basis for U.S. Pat. No. 3,047,243.

In addition, the leading impact face of the heretofore conventional striking plate has a particular structure and inclination relative to the radius of the rotor so that as a slug of particles strikes the impact face, a certain portion of these particles is retained on the impact face and is impacted by the next slug of particles striking the impact face. There are two negative results from impacting particles to be crushed onto a bed of already crushed particles. First, the impact force and hence the disintegrating effect on the large particles as they hit the residual bed of material is measurably cushioned or reduced, resulting in more oversize particles in the crushed product. Secondly, the residual bed of already crushed or impacted material is subjected to further uncontrolled inter-particle impaction which in turn results in the production of a higher percentage of extreme fines in the finished product.

SUMMARY OF THE INVENTION

The purpose, and in fact the results of this invention, is to control the particle paths so that each particle is impacted only once on each row of impact plates, and to insure that this impact action is constantly performed on a cleared or a clean striking plate surface.

The present striking plate has a leading impact face of a particular structure and of an angular relationship with the radius of the rotor assembly so that the wear on the impact face is substantially the same throughout its radial height and accordingly, the effective radial height and angle of the impact face is maintained for longer periods of use.

In addition, each slug of particles striking the impact face will move outwardly along the impact face fast enough so as to provide a clean face surface for the next slug of particles striking the face. Consequently, better and more controlled impaction is afforded in disintegrating the particles, resulting in fewer extreme fines as well as less oversize particles in the finished product. This narrowing of the range between top size of the particles and the extreme fines is very desirable in many crushing applications.

The elongate striking plate has a leading impact face with inner and outer edges, the impact face extending rearwardly from its inner edge toward its outer edge at substantially a constant angle for the major portion of its radial height, and then extends relatively forwardly to its outer edge for a minor portion of its radial height.

The minor impact face portion has sufficient radial height to accommodate a wash area at the juncture of the major and minor impact face portions as wear occurs. Preferably, the radial height of the forwardly extending minor impact face portion is just sufficient to accommodate this wash area.

In assembly, the leading impact face of the striking plate extends rearwardly from its inner edge toward its outer edge at an angle with respect to a radius substantially within the range of fifteen (15) degrees to thirty (30) degrees for the major portion of its radial height. With this inclination, the particles strike the impact face for disintegration, and then move outwardly along such face under centrifugal force, and are then thrown from the outer edge in a ribbon stream of particles. As a result, the wear of the impact face is substantially uniform, and essentially the same angle of inclination and its effective radial height are maintained, during usage. Because the particles move outwardly along the impact face after impaction rapidly enough, a clean impact face surface is provided for impaction by the next slug of particles.

It has been found that the angle with respect to the radius at which the impact face extends is preferably substantially twenty-five (25) degrees, for a 75 inch diameter cage mill having a medium "flowability" and/or "stickiness" consistency to it. Indications are that the smaller the cage diameter and the more "free flowing" material being processed, the less "tilt-back angle" is required for a timely removal of the impacted material to achieve a clean impact face for each succeeding slug of material.

The rearwardly tilting impact face portion has sufficient "tilt-back angle" to insure that a slug of particles striking that face will move radially outward along that face fast enough so as to provide a clean face surface for the next slug of particles impacting on that face. The radial height of this plate is sufficient to accommodate the full slug or "ribbon stream" of material to impact thereon without allowing any portion to radially overshoot the plate and thereby miss impaction by that particular row of impact plates. The specific radial height required will vary according to diameter of cage, circumferential spacing between striking plates, and relative speed of rotation of successive rows. The radial height of the plate rearwardly from the impact face between the inner and outer edges if sufficient to maintain substantially the same angle and radial height of the major impact face portion during use and wear.

Because the particular structure of the striking plate enables a discharge of the particles in a ribbon stream, it is possible to control the lateral flow direction of this ribbon stream to assure effective movement into the next row of striking plates in the rotor cage. This flow control is achieved by the provision of flanges at the ends of the plate extending forwardly of the leading impact face, and having outwardly converging, flow-directing side surfaces adjacent the leading impact face and extending from the inner edge to the outer edge.

These converging side surfaces collect and confine the ribbon stream of particles laterally, and direct such ribbon stream directly into the path of compatible striking plates in the next adjacent outer row.

The striking plate is compressed between the rotor rings for increased plate strength. A clamping rod is extended through the plate and through the adjacent rotor rings, and clamping means are connected to the rod and engage the rings for applying a compression force to attach the striking plate to the rings and to increase material strength. It is a well known fact that most materials when subjected to a substantial compressive force are not only structurally much stronger and stiffer (such as prestressed concrete slabs), but are also much more resistant to surface cutting and abrasive action. This is true of most materials such as rubber, concrete and metals.

The heretofore conventional assemblies using bolting for attachment of the impact striking plates have been merely to position and secure the striking plates in place. The present unique and original concept is to apply and maintain a very substantial compressive loading on the impact striking plates, as for example, at least 5000 lbs. per square inch compression. The dual purpose of this prestressing is to provide greater structural integrity and a better wear resistance to the impact striking plates.

BRIEF DESCRIPTION OF THE DRAWINGS

FIG. 4 is a fragmentary, cross sectional view of a rotor assembly; and

FIG. 5 is a fragmentary, cross sectional view as taken on line 4—4 of FIG. 4.

DESCRIPTION OF THE PREFERRED EMBODIMENTS

Referring now by characters of reference to the drawings, the striking plate 10 and the impact means in which the striking plate 10 is used are fully disclosed. The multiple cage type disintegrating mill in which the striking plate 10 and the impact means are utilized is fully disclosed in U.S. Pat. No. 3,047,243, such disclosure being incorporated by reference herein.

Figure 1:
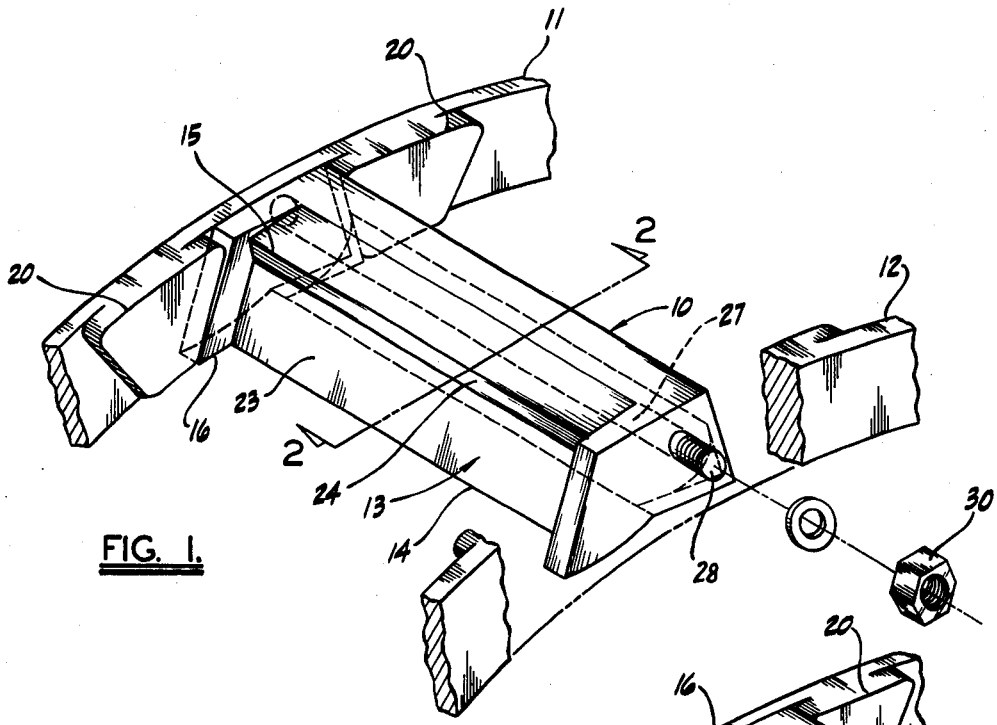
FIG. 1 is a fragmentary perspective view of the impact means between rotor rings, one ring being broken away for clarity.

As disclosed in U.S. Pat. No. 3,047,243, a disintegrating mill of the multiple cage type is shown in FIG. 1 in which a first rotor is mounted for rotation in one direction and a second rotor is mounted for rotation in the opposite direction. The material to be treated is fed into the central chamber defined between the rotor, and then passes outwardly to the periphery of the apparatus as it is processed. The first rotor includes a pair of annular rows of impact means that are disposed alternately with a pair of annular rows of impact means provided on the second rotor such that the particles of the material to be treated will be forced to change direction abruptly as they pass from one row outwardly to another row.

Figure 3:
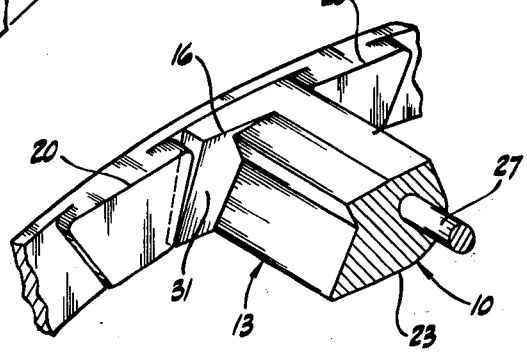
FIG. 3 is a fragmentary perspective view of a modified construction of the impact means between the rotor rings.
Figure 2:
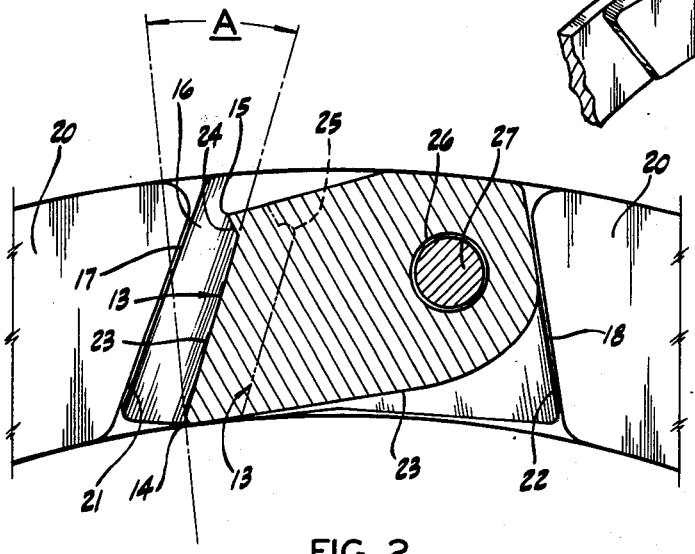
FIG. 2 is an enlarged cross sectional view taken along line 2—2 of FIG. 1.

The apparatus of this type of cage mill is shown in FIGS. 2 and 3 of the drawings of U.S. Pat. No. 3,047,243. This apparatus includes a housing mounted on a suitable support, and a feed chute sealed to the housing and in communication with the central portion of the interior of the housing. One end of the feed chute is in communication with the lower open end of the storage bin adapted to hold a solid granular material or the like, which is to be treated. A conventional feeder assembly of the vibrating type is disposed at the upper end of the feed chute.

The rotor mechanism and the structural arrangement generally of the impact means in such rotor mechanism of this type of cage mill are clearly disclosed in FIGS. 4 and 5 of U.S. Pat. No. 3,047,243 and fully described in such specification. The present invention relates to an improved striking plate and impact means utilized in the rotor mechanism.

Referring now by characters of reference to FIG. 1 of the present drawing, it is seen that the rotor includes a pair of spaced, substantially parallel annular rings 11 and 12. As is usual and as is taught by U.S. Pat. No. 3,047,243, the impact means are mounted between the rings 11 and 12. While one of the impact means is illustrated in FIG. 1, it will be understood that the other impact means are identical in structure.

The elongate striking plate 10 extends between the rotor rings 11 and 12, the striking plate 10 including a leading impact face 13 defined by an inner edge 14 and an outer edge 15.

Formed integrally at each end of the striking plate 10 is a flange 16 adapted to seat contiguously against the inside surfaces respectively of the rotor rings 11 and 12. The end flanges 16 extend forwardly of the leading impact surface 13 to provide a substantially U-shaped front surface. It will be importantly noted that this substantially U-shaped front surface avoids a joint or crack between the striking plate 10 and the rotor rings 11 and 12 in the plane of the impact face 13.

Each of the end flanges 16 is provided with a forward wedge margin 17 that is inclined rearwardly and outwardly at an angle to the rotor radius. Further, each of the end flanges 16 is provided with a rearward wedge margin 18 that is inclined forwardly and outwardly at an angle to the rotor radius.

A keeper plate 20 constituting a plate-retaining means, is secured as by welding to the inside surface of each of the rotor rings 11 and 12 in relatively angularly spaced relation forwardly and rearwardly of the striking plate 10. These keeper plates 20 include rearwardly and outwardly inclined rear wedge margins 21 that engage the front wedge margins 17 of the end flanges 16, and include forwardly and outwardly inclined front wedge margins 22 that engage the rear wedge margins 18 of the end flanges 16. It will be noted that the keeper plates 20 serve to wedge the striking plate 10 in position under the centrifugal force exerted by the striking plate 10 under rotation of the rotor.

It will also be noted that the thickness of the keeper plates 20 closely approximates the thickness of the end flanges 16 at their wedge margins 17 and 18 to provide relatively flush inner surfaces therebetween. These joints between the rear margins 21 of the keeper plates 20 and the front wedge margins 17 of the end flanges 16, are located a substantial distance forwardly of the transverse plane formed by the leading impact face 13 so that any wear created by material traveling over the impact face 13 and along the inner surfaces of the end flanges 16 substantially in the plane of such impact face 13 will not cause any wear at the joints formed by the keeper plates 20.

It will be noted that the striking plate 10 is relieved at the radially-inward, trailing surface 23 to provide a path for particles passing closely adjacent the striking plate 10. This angle at which the striking plate 10 is relieved is defined as the relief angle. This relief angle position required for minimum interference with the pass of the particles will vary because of various conditions, such as the diameter of the rotors, the speed at which they are rotated and the types of material being processed. In any event, the relief angle must be greater than a 90 degree angle with respect to the rotor radius.

Importantly, the leading impact face 13 extends rearwardly and outwardly from its inner edge 14 toward its outer edge 15 at an angle A with respect to the rotor radius within the range of fifteen (15°) to thirty (30°) for the major portion 23 of its radial height. Then, the leading impact face extends relatively forwardly to its outer edge 15 for only a minor portion 24 of its radial height. Preferably, the angle A with respect to the rotor radius at which the impact face 13 extends is substantially twenty-five (25°) for a 75 inch diameter mill crushing a material such as damp soft coal to a nominal minus 6 mesh product with a minimum amount of fines for coke production. The optimum angle A will vary primarily with cage diameter and material characteristics.

The rearwardly extending major impact face portion 23 has sufficient radial tilt-back angle so that a slug of particles striking the face 13 will have moved outwardly along the face 13 fast enough to provide a clean face surface for the next slug of particles striking the face 13. The radial height of the striking plate 10 rearwardly from the impact face 13 between the inner and outer edges 14–15 is sufficient to maintain substantially the same angle A and radial height of the major impact face portion during use and wear. Preferably, the relatively forwardly extending minor impact face portion 24 has just enough radial height to accommodate a wash area 25 (FIG. 2) at the juncture of the major and minor impact face portions 23–24 as wear occurs. The wear pattern of the impact face 13 is illustrated by broken lines in FIG. 2.

The attachment means for the striking plate 10 compresses the plate 10 between the rotor rings 11 and 12 for increased material strength. This attachment means includes an elongate hole 26 in the striking plate 10 spaced rearwardly from the impact face 13 so that a considerable depth of plate material is provided to accommodate wear of the impact face 13. This hole 26 extends through the plate ends and is adapted to be aligned with compatible holes in the associated rotor rings 11 and 12. An elongate clamping rod 27 extends through the plate hole 26 and the compatible ring holes, and clamping means such as nuts 30 are connected to the projecting threaded ends 28 of the rod 26. The nuts 30 are threadedly tightened on the rod ends 28 and urged against the rings 11 and 12 to compress the striking plate 10 between the rings 11 and 12. In addition to merely securely fastening the impact striking plate in place, the striking plate is further compressed longitudinally up to a minimum loading of 5000 lbs. per square inch. This means, for example, if the cross section of the impact striking plate was 20 square inches, the total compressive force desired for each striking plate would be in excess of 100,000 lbs. To attain and hold this force would require a bolt or tension member to be of sufficient cross-section so as to permit its total preloading tension force to match the total compressive force on the impact striking plate. It will also be understood that as the impact striking plate wears and the cross-section is reduced, the bolt tension remains the same and as a result, the pounds per square inch compressive loading increases. For example, if the striking plate wears half way through to a 10 square inch cross-section, the same 100,000 lb. bolt tension would be applying a 10,000 lbs. per square inch unit compressive load on the impact striking plate material.

Because of the particular structure of the striking plate 10 as described previously, the material being treated is discharged from each striking plate 10 of each row in a ribbon stream into the path of the striking plates of the next adjacent outer row. As a slug of these particles from the ribbon stream strike the leading impact face 13 of each striking plate 10, the particles are shattered by the impaction and are then moved radially outwardly along the major impact face portion 23 toward its outer edge 15. When the next slug of particles from the ribbon stream strikes the impact face 13, the major impact face portion 23 presents a clean face surface for such impaction because the preceding slug of particles will have moved outwardly a sufficient distance. Consequently, improved control over the particle size and reduction in the amount of fines, is realized, and substantially the same angle A of the impact face 13 is maintained as the particles engage and move outwardly therealong during usage and wear.

As the particles move outwardly, they will engage the minor impact face portion 24 and be thrown outwardly, preferably with such force and in a direction substantially tangential to the rotor rotation for engagement with the striking plates of the next row. As the particles change direction as they move from the major impact face portion 23 to the minor impact face portion 24, it has been found that a slightly rounded wash area 25 will be formed. The radial height of the minor impact face portion 24 must be sufficient to accommodate this wash area 25 as it develops.

A modified construction of the striking plate 10 is illustrated in FIGS. 3 and 5. In this modified construction, the flanges 16 are provided with outwardly converging, flow-directing side surfaces 31 adjacent the leading impact face 13 and extending from the inner edge 14 to the outer edge 15. Because the particular structural arrangement of the leading edge 13 enables movement of the particles in a deposit layer outwardly along the impact face 13 and enables the discharge of these particles in a ribbon stream from the striking plate 10, these converging side surfaces 31 can be advantageously used to control the width of the ribbon stream to assure that all of the particles in such stream will effectively be introduced into and received by the striking plates of the next adjacent outer row. There is a tendency for the particles to be thrown outwardly in a slightly lateral divergent pattern as they leave the striking plate 10 because of an impact disintegrating "splatter" type of particle action. By converging the ribbon stream particles slightly as they are discharged from the striking plate 10, the entire width of the discharged ribbon stream strikes the impact faces between the converging side surfaces of the end flanges of the next row of striking plates. As a result, it is possible to design a cage mill structure in which most if not all of the striking plates are identical rather than being of different and longer lengths for each successive outer row as is found in most heretofore conventional cage mills of this type. This becomes a more important factor as the multiplicity of rows increases, primarily because it eliminates the need for the outer rows of impact striking plates from becoming so long that they lose a part of their structural strength.

I claim as my invention:

1. A striking plate for a disintegrating mill, comprising:
   a. an elongate plate having a leading impact face with inner and outer edges, the leading impact face extending rearwardly from its inner edge toward its outer edge at substantially a constant angle for the major portion of its height, and extending relatively forward to its outer edge for a minor portion of its height, and
   b. an integral flange at each end of the plate extending forwardly of the leading impact face, the flanges including outwardly converging, flow-directing side surfaces adjacent the leading impact face and extending from the inner to the outer edge.

2. In an impact means adapted for use between a pair of spaced rings of a rotor in a disintegrating mill:
   a. a striking plate having a leading impact face with inner and outer edges, the impact face extending rearwardly from its inner edge toward its outer edge at an angle with respect to a radius substantially within the range of fifteen (15°) to thirty (30°) for the major portion of its radial height, and extending relatively forwardly to its outer edge for a minor portion of its radial height, and
   b. means attaching the striking plate to and between the rings.

3. An impact means as defined in claim 2, in which:
   c. the rearwardly extending major impact face portion has sufficient radial height so that a slug of particles striking the face will totally impact on the face without a portion of the slug of particles missing the radially outer edge of the face.

4. An impact means as defined in claim 3, in which:
   d. the radial height of the plate rearwardly from the impact face between the inner and outer edges is sufficient to maintain substantially the same angle and height of the major impact face portion during use and wear.

5. An impact means as defined in claim 8, in which:
   e. the relatively forwardly extending minor impact face portion at its outer edge has sufficient radial height to accommodate a wash area at the juncture of the major and minor impact face portions as wear occurs.

6. An impact means as defined in claim 2, in which:
   c. an integral flange is provided at each end of the plate extending forwardly of the leading impact face, the flanges including outwardly converging, flow-directing side surfaces adjacent the leading impact face and extending from the inner to the outer edge.

7. An impact means as defined in claim 2, in which:
   c. the attachment means compresses the striking plate between the rotor rings for increased material strength and abrasion resistance.

8. An impact means as defined in claim 2, in which:
   c. the attachment means includes:
      1. an elongate hole in the plate extending through its ends,
      2. compatible holes formed in the rotor rings,
      3. A tension rod extending through the plate and ring holes, and
      4. clamping means connected to the rod and engaging the rings to compress the plate between the rings for increased material strength, the tension rod having sufficient cross-section to provide a minimum compressive loading on the impact striking plate of at least five thousand (5000) p.s.i.

* * * * *